US005374229A

United States Patent [19]

Sencil

[11] Patent Number: 5,374,229

[45] Date of Patent: Dec. 20, 1994

[54] WEIGHT STACK WITH ALIGNMENT SLEEVE

[75] Inventor: Philip Sencil, Anthony, Fla.

[73] Assignee: MedX Corporation, Ocala, Fla.

[21] Appl. No.: 56,758

[22] Filed: May 4, 1993

[51] Int. Cl.[5] ..... A63B 21/06

[52] U.S. Cl. ..... 482/98

[58] Field of Search ..... 482/98–103

[56] References Cited

U.S. PATENT DOCUMENTS

| | | | |
|---|---|---|---|
| 1,053,109 | 2/1913 | Beach | 482/99 |
| 3,971,555 | 7/1976 | Mahnke | 482/98 |
| 4,601,466 | 7/1986 | Lais | 482/98 |
| 4,625,959 | 12/1986 | Schleffendorf | 482/100 |
| 4,691,916 | 9/1987 | Voris | 482/99 X |
| 4,834,365 | 5/1989 | Jones | 482/100 |
| 4,878,662 | 11/1989 | Chern | 482/98 |

*Primary Examiner*—Richard J. Apley
*Assistant Examiner*—John Mulcahy
*Attorney, Agent, or Firm*—William E. Mouzavires

[57] ABSTRACT

A resistance weight stack for an exercise machine includes a stack of weight plates each having identical sleeves fixed in central apertures of the plates for receiving the weight stack pin. The upper and lower ends of the sleeves each have a plurality of equi-angularly spaced projections and recesses. The projections on the upper ends of the sleeves project above the upper surfaces of the associated weights and are received in the recesses of the lower ends of the next adjacent upper weights for locating and angularly aligning the weight plates relative to each other. The sleeves each have a lateral passage through the wall thereof for allowing a key to be inserted into the weight stack pin to connect the plate to the weight stack pin.

15 Claims, 3 Drawing Sheets

WEIGHT STACK WITH ALIGNMENT SLEEVE

BACKGROUND OF INVENTION

The present invention generally relates to weight stacks in exercise and/or testing machines for providing a resistance to movement by an exerciser typically through the medium of a movement arm. Resistance weight mechanisms of the prior art have included either a weight stack or a free weight system. In free weight systems, one or more weights are directly mounted to a movement arm. In a weight stack, the weights are stacked one above the other and selectively connectible to a weight stack pin which is an elongated rod extending through central holes in each of the weights. Alignment of the weights is achieved through guide rods located on opposite sides of the pin and extending through holes in the weights on opposite sides of the central holes. The weights are selectively connected to the pin by inserting a key through apertures in the plates and in the weight stack pin.

The present invention is concerned with the weight stack type of resistance described above. One development in the prior art relating to weight stacks has eliminated the guide rods by utilizing projections and recesses on the weights for aligning the weights in the weight stack. Such improvements are shown for example in U.S. Pat. No. 3,971,555 issuing Jul. 27, 1976 and U.S. Pat. No. 4,625,959 issuing Dec. 2, 1986. Additionally, an improvement over the weight alignment methods disclosed in the aforementioned patents is disclosed in U.S. Pat. No. 4,834,365 issuing May 30, 1989 to Arthur A. Jones. In this patent, semi-spherical projections are provided on the weights for seating in recesses of the weights.

OBJECTS OF THE PRESENT INVENTION

An object of the present invention is to provide improved methods and structure for locating and aligning weights in a resistance weight stack which is used for example in exercise and/or testing machines and methods. Included herein is a provision of such methods and structure which eliminate the need for guide rods in a weight stack while at the same time simplifying the weights themselves including the manufacture of the weights. Further included herein is the provision of such methods and apparatus which eliminate the need of using projections and recesses formed in weights on opposite sides of the stack pin in a weight stack in order to locate and align the weights in the stack.

A further object of the present invention is to provide a novel and improved weight stack which may be used to provide a resistance to exercise and/or testing of various parts of the human body.

A further object of the present invention is to provide a novel and improved weight for use in a weight stack to provide a resistance. Included herein is the provision of such a weight which will self-align and locate it itself with respect to other weights in a weight stack upon lowering of the weight during, for example, an exercise. Further included herein is the provision of a novel and improved assembly of parts which may be utilized to efficiently produce the weight.

SUMMARY OF INVENTION

One aspect of the present invention provides a weight stack in which a plurality of the weights have central apertures receiving a weight stack pin and with projections and recesses formed about the apertures on opposite sides of the weights for locating and aligning the weights. Another aspect of the present invention pertains to a weight to be included in a weight stack. The weight has an aperture typically located in a central portion thereof for receiving a weight stack pin. On opposite sides of the weight about the aperture are a plurality of projections and recesses for registering with other projections and recesses formed on another weight to be included in a weight stack. The projections and recesses include cam surfaces that are able to slightly rotate the weight into proper alignment with an adjacent weight in a weight stack, it being understood that the adjacent weight is similarly formed with the projections and recesses referred to above.

In the preferred embodiment, the projections and recesses provided about the central aperture of the weight are formed in a sleeve which is fixed in the central aperture of the weight. The sleeve is formed from suitable material that has dimensional stability and is resistant to impact and abrasion.

DRAWINGS

Other objects and advantages of the present invention will become apparent from the following more detailed description taken in conjunction with the attached drawings in which.

DETAILED DESCRIPTION

Figure 1:
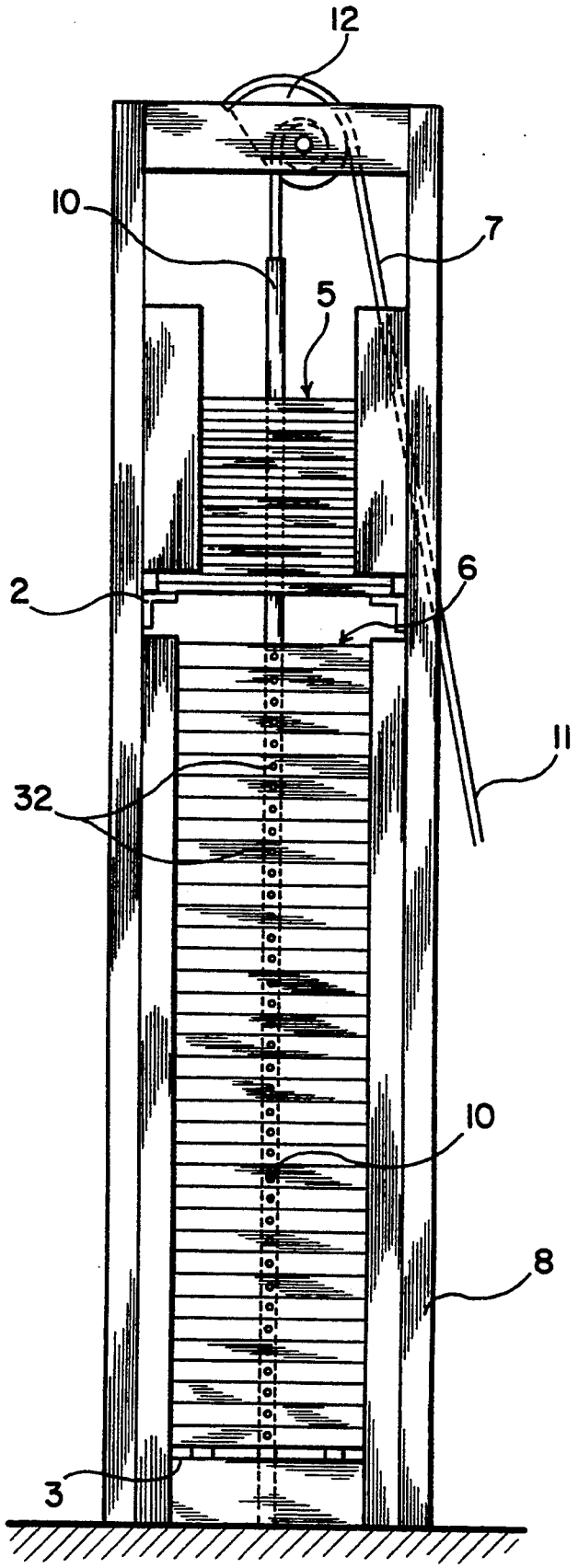
FIG. 1 is an elevational view of a weight stack embodying the present invention.
Figure 3:
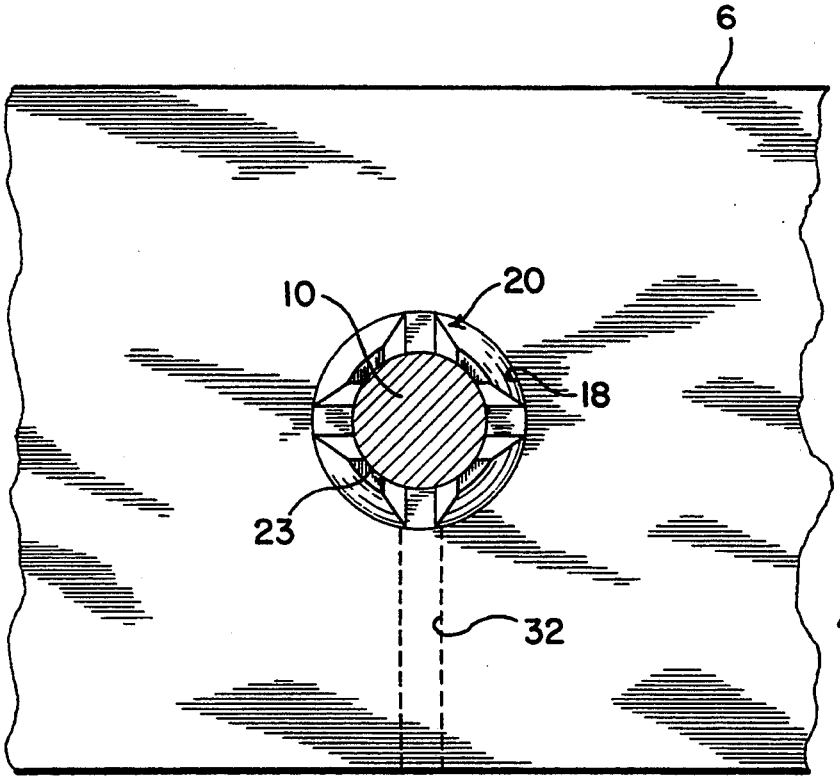
FIG. 3 is a cross-sectional view through a weight stack pin in the weight stack of FIG. 1 and showing the upper surface of a weight.
Figure 4:
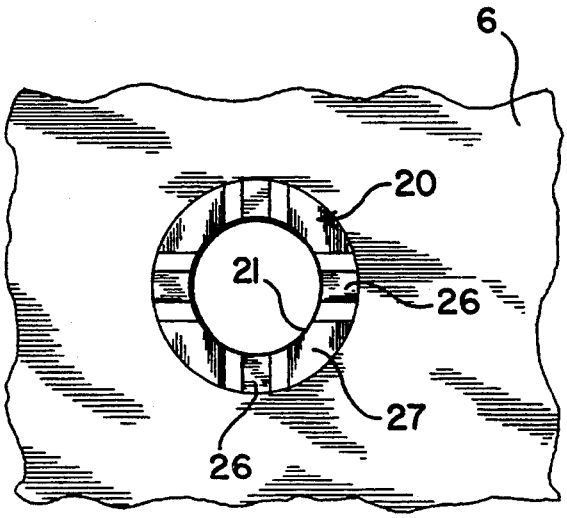
FIG. 4 is a fragmental plan view of the bottom of the weight shown in FIG. 3 but excluding the weight stack pin.

Referring now to the drawings in detail there is shown for illustrative purposes only in FIG. 1, a weight stack embodying the present invention and including a basic vertical frame structure 8, an upper stack of weight plates 5 and a lower stack of weight plates 6. Upper and lower stacks 5 and 6 are independently supported on fixed supports generally located at 2 and 3 so that they may be connected to a weight stack pin 10 extending vertically through central apertures in the weights which may thus be moved independently of each other. Each of the weight plates in stacks 5 and 6 have elongated passages 32 extending transversely thereof for receiving a key (not shown) which also extends into the weight stack pin 10 for purposes of connecting a weight plate to pin 10 in well-known manner. FIG. 1 shows passages 32 only in the lower stack 6, however it should be understood that the weights of the upper stack 5 will have similar passages. FIG. 3 shows one of the passages in a weight plate 6. In the preferred embodiment, the weight plates 5 of the upper stack are lighter than those of the lower stack 6. For example, in one embodiment the upper plates 5 may be made from aluminum with a weight of 2 lbs. each, while the lower plate 6 may be made from steel with a weight of 20 lbs. each.

Further in the preferred embodiment, the upper plates and lower plates are each generally rectangular in outline and for example the upper plates may be about 11 inches long, 2½ inches wide and ¾ inch in thickness, while the lower plates might each be about 12 inches long, 6 inches wide and 1 inch thick. The weight stack pin 10 has a diameter of approximately 1 inch.

In use, weights from the upper and/or lower stacks 5 and 6 are raised through means of a cable or chain 11 trained about a cam 12 rotatable about a horizontal axis and being connected to the stack pin 10 as shown in FIG. 1. Any weight plates 5 and/or 6 connected to the pin 10 will of course move with the pin together with all weight plates located above the plate connected to the pin 10. For a more detailed description of a compound weight system, reference should be had to U.S. Pat. No. 4,834,365 the disclosure of which is hereby incorporated by reference into the subject application as part thereof.

Each of the weight plates in the upper stacks 5 and 6 have apertures preferably in the center of the plates extending transversely through the plates between upper and lower surfaces thereof for receiving the weight stack pin 10 in well-known manner. However, in accordance with the present invention each of the plates are provided with projections 23 raised from the top surfaces 6*a* thereof to be received in recesses 27 in the bottom surfaces of the next adjacent upper plate for locating and aligning the latter. The projections 23 in the preferred embodiment are tapered inwardly in conical fashion for allowing the next upper plate to locate itself concentrically with respect to the lower plate. Moreover cam surfaces are provided on opposite sides of the projections 23 to allow the upper plate to undergo slight angular movement relative to the lower plate to properly align itself.

Although the projections from the upper surface and the recesses in the lower surface of the plates 5 and 6 may be formed as an integral part of the plates by machining, milling, moulding, etc., in the preferred embodiment they are formed on a sleeve generally designated 20 which is fixed in the central holes 18 of the plates preferably by a press-fit. Sleeve 20 is made from a material that has dimensional stability and can withstand impact loads and abrasion. Any suitable metallic or synthetic material such as NYLON or DELRIN may be employed. It is preferred however that a material including nylon, rubber and glass fibres be employed. Rather than a press-fit, any other suitable means such as pinning and/or bonding may be employed to fix the sleeve 20 in the weight plate.

Figure 2:
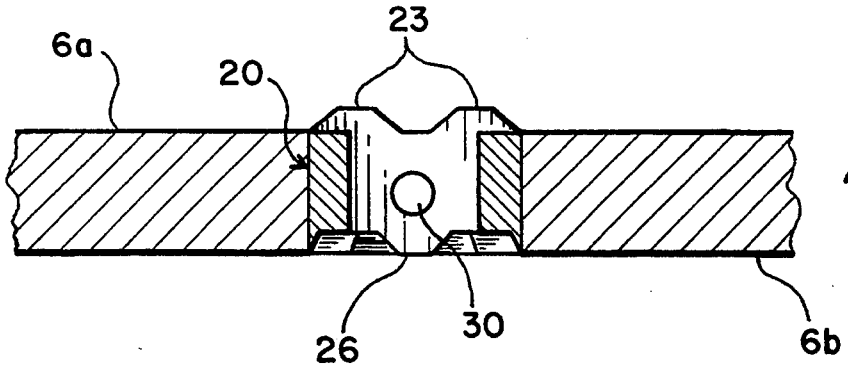
FIG. 2 is a longitudinal cross-sectional view of a weight constructed in accordance with the preferred embodiment for use in the weight stack of FIG. 1.
Figure 7:
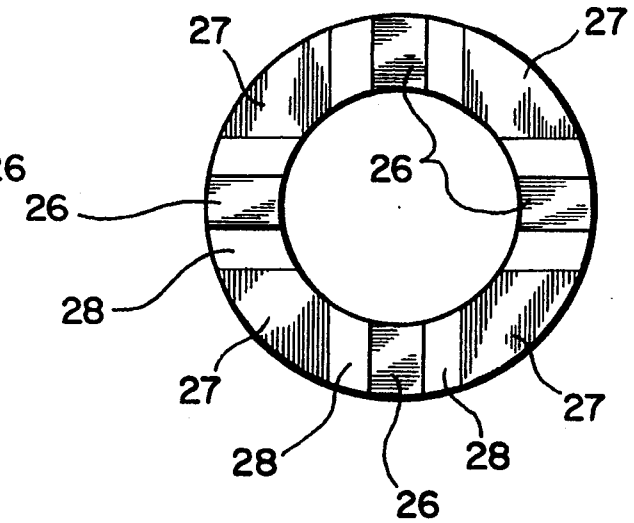
FIG. 7 is a bottom end view of the sleeve opposite that of FIG. 5.
Figure 6:
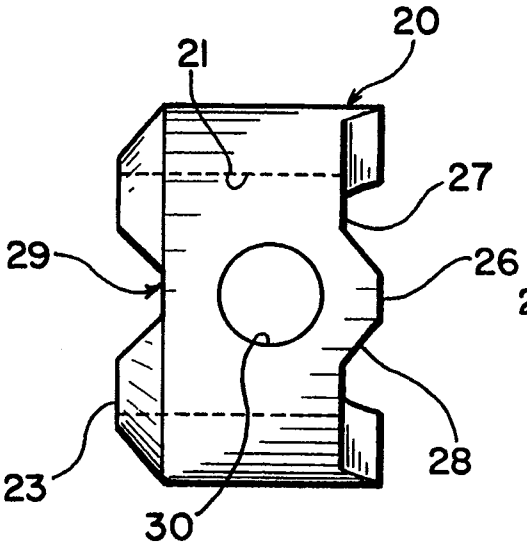
FIG. 6 is a side view of the sleeve of FIG. 5.
Figure 5:
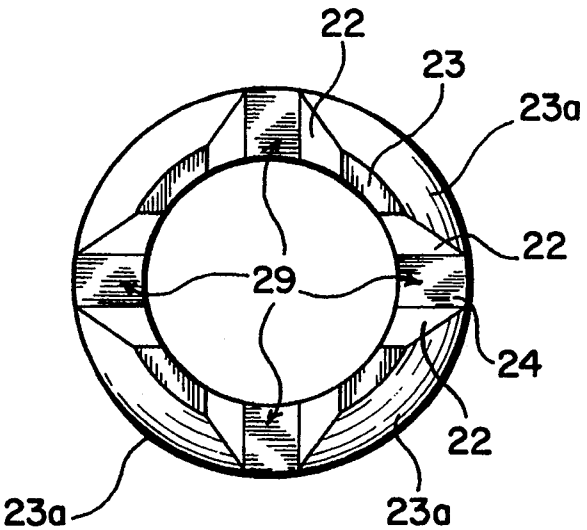
FIG. 5 is a top end view of a sleeve incorporated in the weights of the weight stack.

Referring to FIGS. 5, 6 and 7, sleeve 20 has a generally cylindrical shape with the upper end shown in FIG. 5 having projections 23 and recesses 21 equi-angularly spaced about the periphery and with the lower end having projections 26 and recesses 27 angularly spaced about its periphery. Referring to FIG. 2, sleeve 20 is received in central hole 18 of the associated plate 6 so that the projections 23 are raised above the upper surface 6*a* of plate 6 and so that the lower end surface of sleeve 20 formed by the outermost surfaces of projections 26 lie in a plain generally flush with the lower surface 6*b* of the plate. When the plates are mounted on the weight stack pin 10, the pin is received in the axial passage 21 of the sleeve as best shown in FIG. 3.

Referring to FIG. 5, the upper end of sleeve 20 includes generally conical surfaces 23 which constitute outer surfaces of the projections 23 tapering inwardly towards the axis of the sleeve 20 for purposes of concentrically locating the next upper plate. In addition, each projection 23 on opposite sides thereof has tapering surfaces 22 which extend downwardly from the outermost surfaces 23 to form recesses generally designated 21. In the preferred embodiment shown in FIG. 6, surfaces 22 extend generally 90° relative to each other between projections 23. In addition in the preferred embodiment there are four equi-angularly spaced projections 23 and four recesses 21 equi-angularly spaced between the projections 23 as best shown in FIG. 5.

Referring to FIG. 7, the lower end of each sleeve 20 includes four equi-angularly spaced recesses 27 formed between four equi-angularly spaced projections generally designated 26, each of which has opposite tapering surfaces 28 on opposite sides thereof. As shown in FIG. 2, the outermost surfaces 26 of the projections are located in a plane generally flush with the lower surface 6*b* of the associated plate and thus the recesses 27 in the lower end of the sleeve 20 lie within the body of the plate adjacent the lower surface 6*b*. The recesses 27 in the lower end of the sleeve 20 are dimensioned and shaped to respectively receive projections 23 in an identical sleeve located in a plate lying next below it. That is to say that the projections 23 from the upper surface of the plate 6 are received in the recesses 27 in the next adjacent upper plate. The conical surface portions 23*a* of projections 23 serve to concentrically locate the next upper plate while the tapering surfaces 22 on opposite sides of projections 23 and the tapering surfaces 28 on opposite sides of the projections 26 allow the upper and lower plates to move angularly with respect to each other to bring them into alignment forming a rectangular stack. When the plates are properly located and aligned, and the weight stack pin 10 is lowered, the plates will lie one on top of the other with their surfaces in generally flush engagement as best shown in FIG. 1.

In the preferred embodiment the wall of sleeve 20 is provided with a radially extending aperture 30 communicating with the axial passage of sleeve 20 for receiving a key for connecting the weight plate to the weight stack pin 10 as described above. FIG. 6 shows the passage 30 while FIG. 3 shows passage 32 in the weight plate 6 which is in alignment with passage 30 of sleeve 20 for purposes of receiving a connecting key as described. In the preferred embodiment where the overall depth or height of the sleeve is 1.188 inches and the diameter is 1.75 inches, the aperture 30 has a diameter of 15/32 inches. Moreover, the projections 23 and 26 have a height of approximately 0.188 inches. Furthermore the recesses 21 in one end of the sleeve 20 have a circumferential length of 0.250 inches to equal the circumferential length of the projections 26 in the lower end of sleeve 20.

It will thus be seen that in operation in a weight stack during an exercise, when the plates are raised and lowered, the generally complementary projections and recesses in the upper and lower surfaces of each of the weight plates will serve to locate and align the plates in proper orientation thereby not only avoiding the need of conventional guide rods but also the need to provide projections and recesses on opposite sides of the central aperture 18 of each of the plates as disclosed in U.S. Pat. Nos. 3,971,555, 4,625,959 and 4,834,365 identified above. The present invention therefore significantly reduces manufacturing costs of the weight plates while at the same time being applicable to conventional weight plates without major modification.

Although a specific embodiment of the invention has been shown and described above, the scope of the present invention is not limited to the specific embodiment shown but rather is covered by the attached claims appearing below.

It is claimed:

1. A stack weight to be used in a weight stack to provide resistance comprising:

a weight having a body including upper and lower opposite surfaces and a passage extending between said upper and lower surfaces;

a sleeve located in said passage and fixed to said body, said sleeve having a sleeve passage extending along said passage and dimensioned to receive a weight stack pin, said sleeve passage defining an axis, said sleeve having an upper end including a plurality of projections extending above said upper surface of said body and being angularly spaced from each other about said axis of said sleeve passage, said sleeve having a lower end opposite the upper end and including a plurality of angularly spaced recesses, said recesses being recessed inwardly from said lower surface of said body, the shape of said recesses and projections functioning to align said body and said passage with the body and passage of another stack weight stacked on said claimed stack weight and containing projections and recesses complementary to said recesses and projections of said claimed stack weight.

2. The stack weight defined in claim 1 wherein said projections on said upper end of said sleeve include inwardly extending conical surfaces on the outer sides of said projections for aligning said passage of said body with a passage in another weight, and oppositely located tapered surfaces on opposite sides of the projections for angularly moving the body into alignment with the body of another weight.

3. The stack weight defined in claim 2 wherein said lower end of said sleeve includes oppositely located tapered surfaces on opposite sides of said recesses.

4. The stack weight defined in claim 3 wherein said projections on said upper end of said sleeve are equi-angularly spaced from each other and wherein the recesses in said lower end of said sleeve are equi-angularly spaced from each other.

5. The stack weight defined in claim 4 wherein there are four projections on said upper end of said sleeve and four recesses in said lower end of said sleeve.

6. In a weight stack providing resistance to movement in an exercise and/or testing apparatus, said weight stack including upper and lower weights having aligned apertures and a weight stack pin received through said aligned apertures and adapted to be connected to a said weight to raise or lower said weight, said weight stack being free of any guides extending through said weights other than said stack pin, the improvement comprising:

said weights each having sleeves located and fixed in said aligned apertures, said sleeves each having a sleeve passage dimensioned to receive said weight stack pin, said sleeve in said lower weight having a projection extending above an upper surface of said weight, said sleeve in said upper weight having a recess in a lower end thereof for receiving said projection of said lower weight, and means on said projection and in said recess for aligning said weights upon receipt of said projection in said recess.

7. The weight stack defined in claim 6 wherein the sleeve of the lower weight includes a plurality of said projections extending above the lower weight and wherein said sleeve of the upper weight has a plurality of recesses in the lower end thereof respectively receiving the projections of the lower weight, and wherein said projections and recesses are generally complementary for purposes of preventing rotation of said upper and lower weights relative to each other once the projections are received in the recesses.

8. The weight stack defined in claim 7 wherein said sleeve passage defines an axis and said projections and recesses are equi-angularly spaced about said axis of said sleeves respectively.

9. The weight stack defined in claim 7 wherein said projections on said upper end of said lower weight have outer conical surfaces and opposite tapered side surfaces for locating and angularly aligning said upper and lower weights.

10. The weight stack defined in claim 9 wherein said recesses in said lower end of said sleeve of said upper weight have tapered surfaces on opposite sides thereof engageable and generally complementary to said tapered surfaces of said sleeve of said lower weight.

11. The weight stack defined in claim 9 wherein said associated opposite tapered surfaces extend at approximately 90° relative to each other.

12. The weight stack defined in claim 6 wherein each of said sleeves has a lateral passage extending through a wall thereof and communicating with a passage in the associated weight for receiving a key for connecting said weight to said weight stack pin.

13. The weight stack of claim 6 wherein said projection extends inwardly and has opposite inclined side surfaces.

14. A stack weight to be used in a weight stack to provide resistance comprising:

a weight having a body including upper and lower opposite surfaces and a passage extending between said upper and lower surfaces;

a sleeve located in said passage and fixed to said body, said sleeve having a sleeve passage extending along said passage and dimensioned to receive a weight stack pin, said sleeve passage defining an axis, said sleeve having an upper end including a plurality of projections extending above said upper surface of said body and being angularly spaced from each other about said axis of said sleeve passage, said sleeve having a lower end opposite said upper end and including a plurality of angularly spaced recesses dimensioned to receive projections from a weight located next below said weight, said recesses in said lower end of said sleeve being recessed inwardly from said lower surface of said body, and wherein said projections on said upper end of said sleeve include inwardly extending conical surfaces on the outer side of said projections for aligning said passage of said body with a passage in another stack weight, and oppositely located tapered surfaces on opposite sides of said projections for angularly moving said body into alignment with the body of another stack weight, and wherein said lower end of said sleeve includes oppositely located tapered surfaces on opposite sides of said recesses.

15. The weight defined in claim 14 wherein said projections on said upper end of said sleeve are equi-angularly spaced from each other and wherein said recesses in said lower end of said sleeve are equi-angularly spaced from each other.

* * * * *